United States Patent [19]

Hammar

[11] 4,129,408

[45] Dec. 12, 1978

[54] GAS BURNER LIGHTING DEVICE FOR AN ABSORPTION REFRIGERATING APPARATUS

[75] Inventor: John R. Hammar, Molle, Sweden

[73] Assignee: Aktiebolaget Electrolux, Stockholm, Sweden

[21] Appl. No.: 734,549

[22] Filed: Oct. 21, 1976

[30] Foreign Application Priority Data

Nov. 20, 1975 [SE] Sweden ..... 75130617

[51] Int. Cl.[2] ..... F23D 11/36

[52] U.S. Cl. ..... 431/251; 431/146; 431/153; 126/37 R

[58] Field of Search ..... 431/36, 37, 144, 146, 431/150, 249, 251, 350, 153, 130, 135; 126/112, 37

[56] References Cited

U.S. PATENT DOCUMENTS

| | | | |
|---|---|---|---|
| 2,019,165 | 10/1935 | Smith | 431/135 |
| 2,187,320 | 1/1940 | Hoffstetter et al. | 126/37 R |
| 2,513,051 | 6/1950 | Ray | 431/153 |
| 2,808,497 | 10/1957 | Kesling et al. | 126/37 R |
| 3,104,534 | 9/1963 | Polisena | 431/249 |
| 3,548,804 | 12/1970 | Faehling | 126/37 R |

*Primary Examiner*—Henry C. Yuen
*Attorney, Agent, or Firm*—Alfred E. Miller

[57] ABSTRACT

A device associated with a gas burner of an absorption refrigerating apparatus that ensures the lighting of the gas burner without the requirements of special knowledge and ability. The device includes a burner housing in a sealed system having a part that is movable against the action of a spring in order to establish communication between the normally closed combustion system and the atmosphere.

3 Claims, 4 Drawing Figures

GAS BURNER LIGHTING DEVICE FOR AN ABSORPTION REFRIGERATING APPARATUS

BACKGROUND OF THE INVENTION

The use of a gas burner is well known in an absorption refrigeration apparatus. The gas is commonly supplied by a conduit with a safety shut-off valve that can be manually disconnected. As is known, the gas burner is used for supplying heat, for example, to a boiler arrangement of the refrigerator. Absorption refrigerators usually operate either by means of gas or electric, however, in house trailers or boats, as well as remote locations where electric power is not always available, a gas burner is utilized. The gas burner for the absorption refrigeration apparatus operates in a closed sealed system which has an intake for combustion air from the ambient and expels combustion or other exhaust gases from the system. Most commonly the gas burner is enclosed in a burner housing located in the lowest part of the sealed system. On many occasions, when cold, humid air is present in the burner housing, and an attempt is made to start up the refrigerator, it often occurs that the first attempt to ignite the burner is unsuccessful. The ignition of the burner is usually brought about by means of an electric spark generated between an electrode and the burner nozzle while gas is being emitted to said burner nozzle. If the first attempt to start up the burner is unsuccessful, the likelihood of success on the second and following attempts are not very good since the mixture of gas and cold air present in the burner housing is not the proper mixture for ignition.

One attempt to overcome the above mentioned drawback has been proposed which incorporates a channel connected to the burner housing by means of an aperture in the wall or bottom thereof. Thus, the free end of the channel is tightly closed during the normal operation of the burner in order to maintain a sealed system, and is opened only when the starting up of the burner has not been successful. This arrangement has resulted in only a limited success since the desired ignition of the burner can only be achieved by a person having a certain skill in handling of the start-up device.

An object of the present invention is to provide a lighting device for a gas burner of an absorption refrigeration apparatus without the requirement of special knowledge or ability to ignite the burner. The device includes a construction and arrangement in which part of the burner housing of the sealed system is movable against spring action by means of an element disposed near the disconnecting means of a safety shut-off valve.

Another object of the present invention is to provide a manual arrangement in which gas is supplied to the burner and the sealed combustion system is opened to the atmosphere.

A further feature of the present invention is to provide an arrangement whereby atmosphere is admitted to the gas burner housing before the gas supply is furnished to said housing.

A further object of the present invention is to provide a relatively simple but reliable device for igniting a gas burner of a refrigerator.

In order that the invention will be more clearly understood, it will now be disclosed in greater detail with reference to the accompanying drawings, in which:

FIG. 1 is an elevational view, partly in section, of a space housing an absorption refrigerator operated by gas burner in a sealed combustion system, FIG. 2 is a horizontal section partly in elevation taken on the lines II-II of FIG. 4, the lighter of the gas burner device being in an inactive position, and being the subject of the present invention, FIG. 3 is a view similar to that of FIG. 2, however, with the lighter of the gas burner in an active position, and FIG. 4 is a vertical section taken on the lines IV—IV of FIG. 3.

DESCRIPTION OF THE PREFERRED EMBODIMENT

Figure 1:
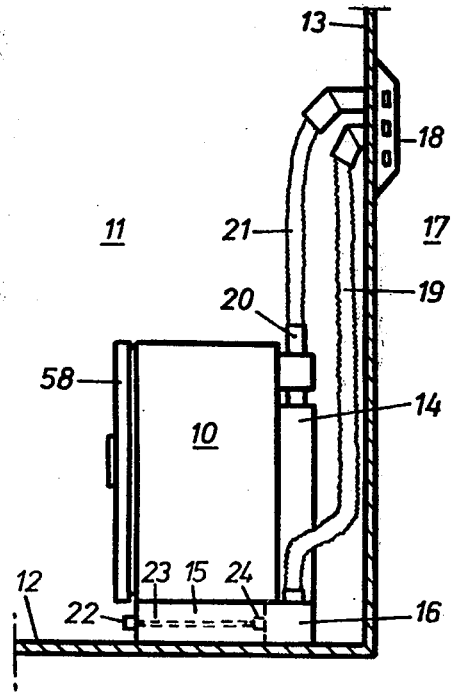

A refrigerator 10 is shown in FIG. 1 located in a space 11 having a floor 12 and a wall 13 that can be parts of a house trailer, a boat or the like. The refrigerator 10, which is shown in diagrammatic form, is driven by an absorption refrigerating system of which only the insulated boiler housing 14 is shown. The remainder of the apparatus can be of any known type and requires no further description. The refrigerator is mounted on a support frame 15 having a rear part which accommodates a burner housing 16 for a gas burner. Combustion air for the gas burner is drawn in from the ambient 17 through a valve 18 located in the wall 13, and an air conduit 19. The combustion gases from the burner pass through a flue 20 in the boiler housing 14. The flue is connected to an exhaust gas conduit 21 opening into the valve 18. It should be noted that the exhaust gases cannot enter the space 11, but rather are discharged into the ambient 17. In the front of the frame 15 and below the refrigerator 10, are push buttons 22 connected by rods 23 to the control means 24 in the burner housing 16.

Figure 2:
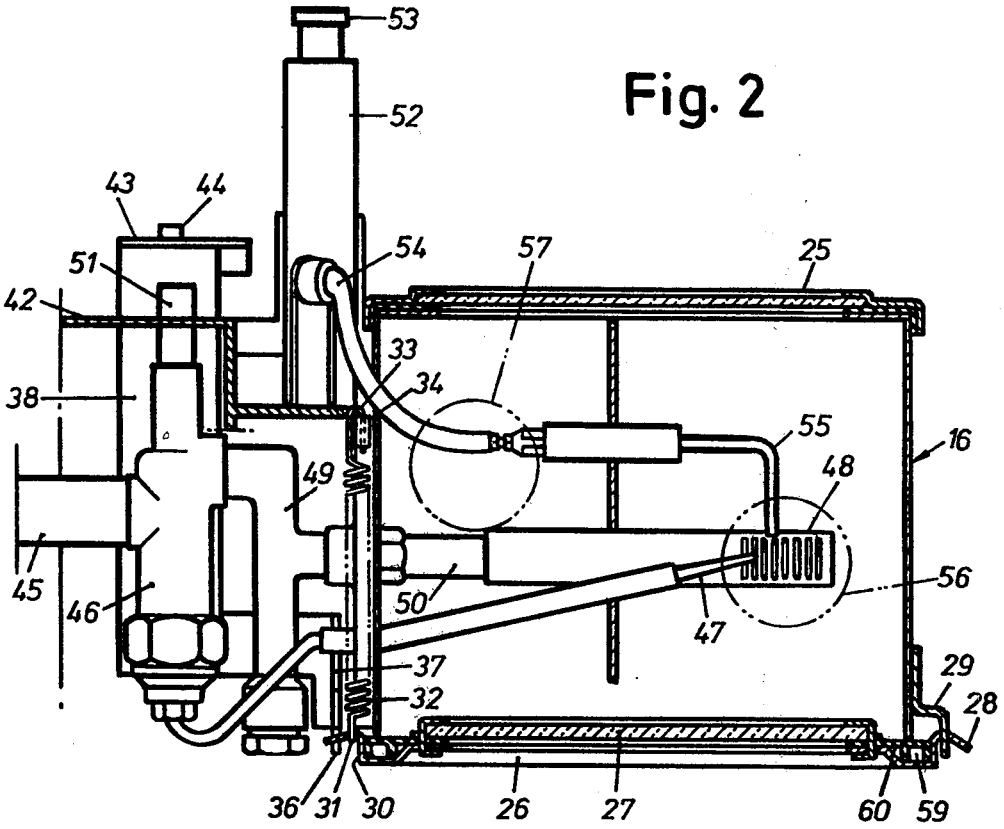
Figure 4:
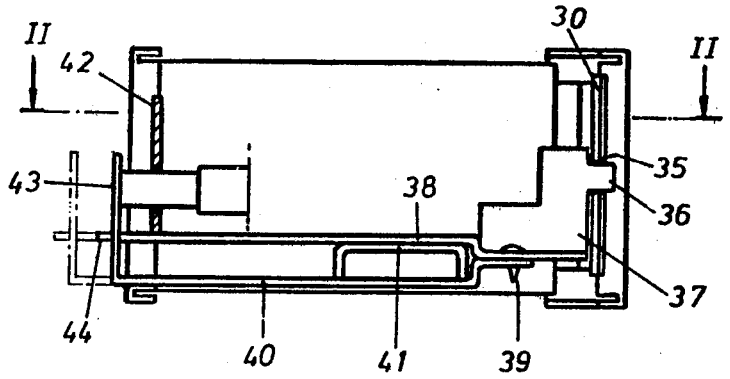

Referring now to FIG. 2, the burner housing 16 is shown on an enlarged scale, and also some parts connectecd to the housing. The burner housing 16 comprises a square or rectangular metal box with a sight glass 25 on the side directed towards the front of the refrigerator, and a door 26 on the opposite side, which faces the rear of the refrigerator, or the wall 13. The door 26 is mainly for inspection and service of the burner, as well as the parts thereof, The door 26 also has a sight glass 27 and is hinged by a fork 28 to a bracket 29 secured to the housing 26. At the side of the door 26, which is opposite the fork 28, the door plate is bent to form a groove 30 for a u-shaped spring device. The spring has a straight part 31 lying in the groove and on either side a coil 32, and which by a hook 33 engages a holder 34 on the housing or on members connected to the housing. A wall of the groove 30 continues in a vertical metal plate edge with a central cut 35 (FIG. 4). A vertical part 37 of an angular metal plate engages the cut by a lug 36, the other part 38 of the angular plate being horizontally disposed and fastened by a screw 39 to another horizontal metal plate 40, which together with the part 38 encloses a part 41 of a frame 42 connected to the housing 16. As seen in FIG. 4, the plates 38 and 40 form a guide which permits movement of the plates by means of an upwardly bent part of the plate 40 forming a pressure plate 43. The plate 38 has a lug 44 which projects through a hole in the pressure plate 43.

Referring to FIG. 2, a gas supply conduit 45 is shown mounted on the frame 42. The latter can also contain a filter, disconnecting means, etc. The conduit can be connected to a safety shut-off valve 46, with a sensor 47 positioned near the gas burner 48 in the housing 16. When the burner operates, the sensor 47 is active and keeps the safety shut-off valve open so that gas from the conduit 45 passes through a conduit 49 and 50 to the gas burner 48. However, the valve 46 can also be opened manually by a push button 51 in order to supply gas to the burner 48, also when the latter is in an inactive condition.

In the embodiment shown herein, the burner is lighted by a piezoelectric lighter 52 having a push button 53 by which a stroke can be applied to a piezoelectric crystal. The voltage thus generated is conducted from the crystal by a wire 54 to an electrode 55 whose tip is close to the burner 48 so that sparks are thrown off from the electrode 55 to the burner 48.

In FIG. 2 the position of the flue is indicated by the dotted circle 56 over the burner housing and the connection for the supply of fresh air by another dotted circle 57.

Figure 3:
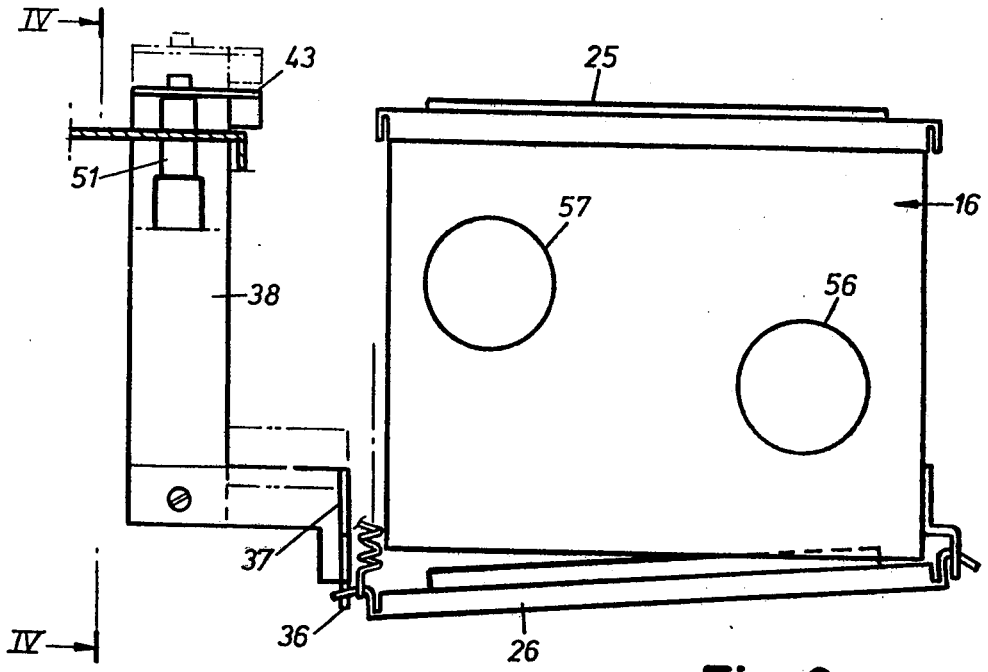

In order to light the electrode 55 the following procedure is necessary: The push button 22 at the front of the support frame 15 and below the door 58 of the refrigerator 10 is depressed. The rod 23 transmits the movement to the pressure plate 43 which, as shown in FIGS. 3 and 4, is moved a distance forwards towards the gas conduit so that the door 26 on one side of the burner housing 16 is opened by means of the plates 38 and 40 and the vertical part 37. Thus, a communication between the normally closed combustion system and the atmosphere is established. Furthermore, there is a continued forward movement of the pressure plate 43 as well as the push button 51 of the valve in the safety device 46 which is acted upon. In addition, a push button behind the button 22 in FIG. 1 is depressed which by a special transmission acts on the push button 53 of the lighter 52. In this manner, the gas valve is kept open, and the burner can be observed through one of the sight glasses, preferably the front glass 25, whose light is led by a light conductor in the support frame 15 to the front of the frame so that it can be seen whether or not the gas has been ignited. If the attempt has been successful the pressure plate 43 should be kept in its depressed position for a while so that the sensor 47 is heated by the burner, and which keeps the safety valve open. If the attempt has failed, another attempt is made with a spark from the lighter 52, still with the door 26 open. As seen in FIG. 2, the plate of the door 26 is surrounded by a groove 59 in which is a rubber strip 60 that seals against the edge of the housing 16, when the door 26 is in a closed position.

No particular ability is necessary to light the burner in the device described since one push button, that of the gas valve, is kept depressed, and the other, that of the burner 52, is used repeatedly until the burner commences to operate.

What is claimed:

1. In a sealed combustion system having a gas burner, a source of gas supply and a conduit for conducting gas to said burner, a safety shut-off valve for said gas supply provided with a manual disconnecting means, the improvement comprising; a frame, a housing for said gas burner having a door, a spring connected at one end to said frame or housing and at the other end to said door, and a member movable to operate said manual disconnecting means and to open said door of the gas burner housing to the atmosphere against the pressure of said spring, said movable member being a pressure plate that moves to establish communication between said gas burner housing and the atmosphere first before operating said manual disconnect means, the latter permitting a supply of gas to be furnished to said gas burner.

2. The combination as claimed in claim 1 wherein said manual disconnecting means is a push button.

3. The combination as claimed in claim 1 wherein said door is normally closed and is swingably mounted and is capable of moving outwardly against the pressure of said spring.

* * * * *